US012710187B2

(12) United States Patent
Stephens et al.

(10) Patent No.: US 12,710,187 B2
(45) Date of Patent: Aug. 18, 2026

(54) SYSTEMS AND METHODS FOR CONTROLLING A MOTOR

(71) Applicant: Regal Beloit America, Inc., Beloit, WI (US)

(72) Inventors: Ryan Keith Stephens, Fort Wayne, IN (US); Bryan James Stout, Fort Wayne, IN (US); Jeffrey Leonard Underwood, Garrett, IN (US); Christopher Allen Mohalley, Racine, WI (US)

(73) Assignee: REGAL BELOIT AMERICA, INC., Milwaukee, WI (US)

( * ) Notice: Subject to any disclaimer, the term of this patent is extended or adjusted under 35 U.S.C. 154(b) by 514 days.

(21) Appl. No.: 17/932,880

(22) Filed: Sep. 16, 2022

(65) Prior Publication Data

US 2024/0093897 A1 Mar. 21, 2024

(51) Int. Cl.
*F24F 11/48* (2018.01)
*F24F 11/65* (2018.01)

(52) U.S. Cl.
CPC ..... *F24F 11/48* (2018.01); *F24F 11/65* (2018.01)

(58) Field of Classification Search
CPC .. F24F 11/48; F24F 11/49; F24F 11/59; F24F 11/65; F24F 11/88; F24F 2221/32
See application file for complete search history.

(56) References Cited

U.S. PATENT DOCUMENTS

| | | | | |
|---|---|---|---|---|
| 2012/0090337 | A1* | 4/2012 | Chen | F25B 49/025 29/890.035 |
| 2014/0139166 | A1* | 5/2014 | Durfee | H02P 31/00 318/494 |
| 2016/0025366 | A1* | 1/2016 | Snow | G05B 15/02 700/276 |
| 2018/0347844 | A1 | 12/2018 | Zhao et al. | |
| 2018/0356847 | A1* | 12/2018 | Mohalley | F24F 11/77 |
| 2019/0082240 | A1 | 3/2019 | Li et al. | |
| 2019/0277527 | A1* | 9/2019 | Muniganti | F24F 11/58 |
| 2020/0363087 | A1* | 11/2020 | Mowris | F24F 11/74 |
| 2021/0285675 | A1 | 9/2021 | Broker et al. | |
| 2022/0252292 | A1 | 8/2022 | Vie et al. | |

* cited by examiner

*Primary Examiner* — Tameem D Siddiquee
(74) *Attorney, Agent, or Firm* — Armstrong Teasdale LLP

(57) ABSTRACT

An interface module configured to control a motor in an HVAC system is provided. The interface module includes a processor coupled in communication with a memory. The processor is configured to wirelessly receive configuration data from a wireless device, store the wirelessly received configuration data in the memory, determine a first operating parameter at which to operate the motor based on the configuration data and at least one signal received from a first device, and control the motor in accordance with the first operating parameter.

19 Claims, 6 Drawing Sheets

SYSTEMS AND METHODS FOR CONTROLLING A MOTOR

FIELD

The embodiments described herein relate generally to motors, and more particularly, to systems and methods for controlling a motor in a heating, ventilation, air conditioning (HVAC) system.

BACKGROUND

Motors used in HVAC and fluid circulation systems often must be programmed to operate according to the specific needs of their systems and may need to be replaced when they do not operate properly or fail. Typically, the motors are programmed using a specialized motor programming computer by an Original Equipment Manufacturers (OEM) at a motor manufacturing facility, at the point of sale, or at an assembly plant.

OEMs that utilize configurable/intelligent motors configure each motor to meet the requirements of the specific product and the expected application. The functionality of the OEM system is derived from a combination of the motor's configuration and the operation of an HVAC system controller. Accordingly, a replacement motor that does not share these configuration and operation characteristics may not function properly when installed into a preexisting system.

BRIEF DESCRIPTION

In one aspect, an interface module configured to control a motor in an HVAC system is provided. The interface module includes a processor coupled in communication with a memory. The processor is configured to wirelessly receive configuration data from a wireless device, store the wirelessly received configuration data in the memory, determine a first operating parameter at which to operate the motor based on the configuration data and at least one signal received from a first device, and control the motor in accordance with the first operating parameter.

In another aspect, a method for controlling a motor in an HVAC system using an interface module is provided. The interface module includes a processor coupled in communication with a memory. The method includes wirelessly receiving configuration data from a wireless device, storing the wirelessly received configuration data in the memory, determining a first operating parameter at which to operate the motor based on the configuration data and at least one signal received from a first device, and controlling the motor in accordance with the first operating parameter.

In another aspect, an HVAC system is provided. The HVAC system includes a motor and an interface module configured to control the motor. The interface module includes a processor coupled in communication with a memory. The processor is configured to wirelessly receive configuration data from a wireless device, store the wirelessly received configuration data in the memory, determine a first operating parameter at which to operate the motor based on the configuration data and at least one signal received from a first device, and control the motor in accordance with the first operating parameter.

DETAILED DESCRIPTION

An interface module configured to control a motor in a heating, ventilation, and air conditioning (HVAC) system is provided according to various embodiments of the present disclosure. The interface module includes processor coupled in communication with a memory. The processor wirelessly receive data (sometimes referred to herein as "configuration data") from a wireless device such as, for example, a smartphone, tablet, personal digital assistant (PDA), and or other device capable of wireless communication with the interface module. The configuration data defines motor control outputs (e.g., serial and/or pulse width modulation (PWM) signals) to be generated by the interface module based on various inputs (e.g., commands received from a thermostat and/or system control and/or data received from sensors). The processor is further configured to stores the configuration data received from the wireless device in the memory.

The processor is further configured to determine a first operating parameter at which to operate the motor based on the configuration data and at least one signal received from a first device (e.g., a thermostat and/or system controller). For example, the processor may determine an operating mode (e.g., cooling, heating, or fan only) based on the at least one signal, and determine a parameter (e.g., a speed, torque, and/or airflow value) based on the operating mode. The processor is further configured control the motor in accordance with the first operating parameter. Because the interface module may be configured using the wireless device, the interface module does not require an onboard user interface.

Figure 1:
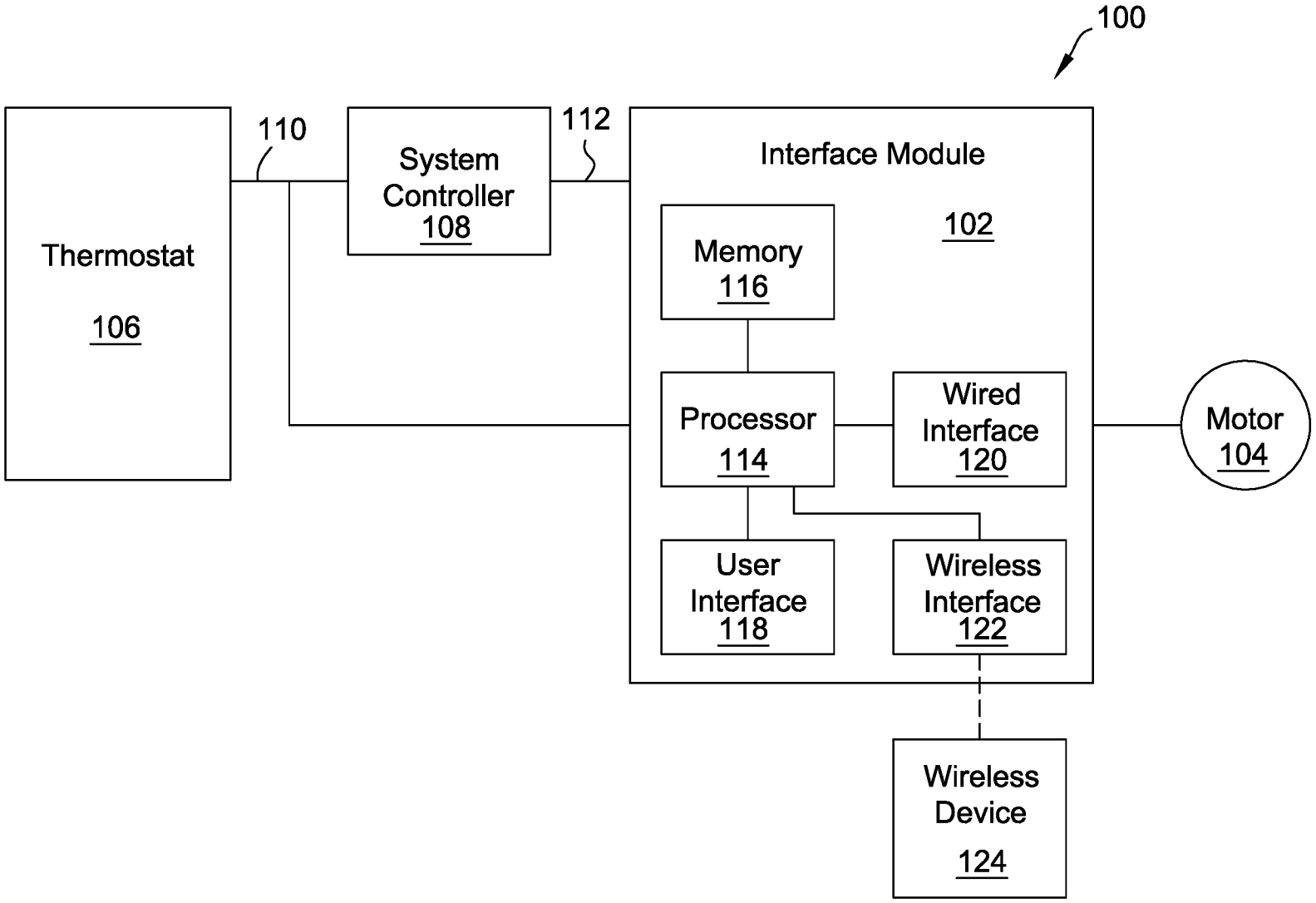
FIG. 1 is a schematic diagram of an example HVAC system that includes an interface module for controlling a motor.

FIG. 1 is a schematic diagram of a heating, ventilation, and air conditioning (HVAC) system 100 that includes an interface module 102 and a motor 104, which may be a retrofit and/or replacement motor. HVAC system 100 also includes a thermostat 106 and a system controller 108. Interface module 102 is coupled to and configured to receive signals from both thermostat 106 and system controller 108. Further, interface module 102 is coupled to and configured to transmit signals to motor 104.

In the example embodiment, motor 104 is an electronically commutated motor (ECM), which may also be referred to as a brushless direct current (DC) motor. Motor 104 is utilized as a fan and/or blower motor in HVAC system 100. Alternatively, motor 104 may be implemented in any other application including, but not limited to, a fluid (e.g., water, air, etc.) moving system, a clean room filtering system, a fan filter unit, a variable air volume system, a refrigeration system, a furnace system, and/or an air conditioning system. In the example embodiment, HVAC system 100 is retrofit to include motor 104 that replaces an existing ECM or permanent split capacitor (PSC) motor (hereinafter referred to as "replaced motor", not shown).

Thermostat 106 is configured to control a mode in which HVAC system 100 is operating, for example, a cooling mode, a heating mode, or a fan only mode, and/or at a first stage or at a second stage. Thus, in the example embodiment, thermostat 106 includes plurality of thermostat leads 110 associated with one or more of a cooling output, a heating output, a fan output, a first stage output, and a second stage output. However, thermostat 106 is not limited to these outputs and may include any number of outputs that enables thermostat 106 to function as described herein. Thermostat 106 generates at least one thermostat signal that is transmitted to at least one of interface module 102 and system controller 108.

System controller 108 includes a system controller wiring harness 112 that was originally coupled to and configured to transmit instructions to the replaced motor. When interface module 102 is provided during the replacement process, system controller wiring harness 112 is coupled to and configured to communicate with interface module 102. For example, system controller 108 relays signals generated by thermostat 106 to interface module 102. More specifically, system controller 108 processes the thermostat signal and generates instructions for operating motor 104 that are provided to interface module 102. System controller 108 may also communicate with other input/output devices, such as humidity control systems, gas burner controls, gas ignition systems, other motors, safety systems, service systems, and/or combustion blowers. Accordingly, system controller 108 generates operating instructions for motor 104 based on signals received from thermostat 106, as well as signals received from alternative devices coupled to system controller 108, such as safety systems, ambient sensors, gas ignition systems, and other HVAC system components.

Interface module 102 receives signals from at least one of thermostat 106 and system controller 108. Based on the received signals, interface module 102 provides motor 104 with control signals. More specifically, interface module 102 receives signals from thermostat leads 110, as well as from system controller 108 via system controller wire harness 112, and is configured to provide motor 104 with a signal that selects a desired motor control profile.

In the example embodiment, interface module 102 includes components mounted to a printed circuit board. More specifically, in the example embodiment, interface module 102 includes a processing device 114, a memory device 116, a user interface 118, a wired interface 120, and a wireless interface 122.

The term processing device, as used herein, refers to central processing units, microprocessors, microcontrollers, reduced instruction set circuits (RISC), application specific integrated circuits (ASIC), logic circuits, and any other circuit or processor capable of executing the functions described herein.

It should be noted that the embodiments described herein are not limited to any particular processor for performing the processing tasks of the invention. The term "processor," as that term is used herein, is intended to denote any machine capable of performing the calculations, or computations, necessary to perform the tasks of the invention. The term "processor" also is intended to denote any machine that is capable of accepting a structured input and of processing the input in accordance with prescribed rules to produce an output. It should also be noted that the phrase "configured to" as used herein means that the processor is equipped with a combination of hardware and software for performing the tasks described herein, as will be understood by those skilled in the art.

Wired interface 120 may include an RS-485 connector, a digital serial interface (DSI) connector, a control wire reception terminal, and/or any other type of interface that allows a user, thermostat 106, and/or system controller 108 to provide a control signal to interface module 102. For example, the control signal may include a 0-10 volts direct current (VDC) control signal, a 0-5 VDC control signal, a 4-20 milliampere (mA) control signal, and/or any other type of control signal that allows interface module 102 to function as described herein.

In the example embodiment, interface module 102 also includes memory device 116. Memory device 116 may be included within processing device 114, or may be coupled to processing device 114. In the example embodiment, memory device 116 stores data (sometimes referred to herein as "configuration data") defining conditions under which interface module 102 generates a control signal for controlling control motor 104, as described in further detail below. Processing device 114 is configured to generate this control signal based on the configuration data stored in memory device 116 and on certain inputs such as, for example, control signals received from thermostat 106 and/or system controller 108, data received from sensors, and/or user input.

In some embodiments, memory device 116 further stores a plurality of different communications protocols. For example, processing device 114 may access the communications protocols stored in memory device 116 in order to translate a signal received from a user via wired interface 120 into a format that may be transmitted to motor 104. More specifically, processing device 114 may receive a signal sent using an Ethernet protocol, in which motor 104 may not be compatible. Processing device 114 translates the received signal to a communication suitable to be transmitted to motor 104.

Interface module 102 includes a user interface 118 that enables user-interaction with interface module 102 and enables interface module 102 to provide feedback with regards to its operation. User interface 118 facilitates configuration (i.e., setup) of interface module 102. Original ECM functionality that is being replicated by interface module 102 is enabled via user interface 118. User interface 118 further enables selection of operational values such as "ON" delay times, "OFF" delay times, duty cycle values, etc.

In some embodiments, user interface 118 includes one or more buttons/switches and/or indicators. In some embodiments, the indicators include LEDs and/or a display. The display, when included, is configured to provide information relating to the operation of interface module 102 including, but not limited to, system control signals status, thermostat signals status, system operating mode, motor torque percent, delay activity, and/or diagnostic (e.g., system health) and self-test information. Alternatively, interface module 102 may be implemented as a "black box" void of any buttons/switches or display.

Interface module 102 is further configured to communicate with a wireless device 124 (e.g., smartphone, tablet, PDA, etc.) using wireless communication (e.g., Wi-Fi, Bluetooth, radio frequency identification (RFID), etc.) via wireless interface 122. Wireless device is configured to 124 run or execute an application ("mobile app") that provides user interface 118 and feedback functions. Wireless device 124 is further configured to (e.g., in response to user input) generate configuration data, and/or instructions for processing device 114 to update the configuration data stored in memory device 116, and to transmit the generated configuration data and/or instructions to interface module 102. Accordingly, wireless device 124 enables a user to set up, reconfigure, and/or review feedback from interface module 102 without a need for direct physical interaction with interface module 102.

Interface module 102 is configured to determine an operating mode of HVAC system 100 (heat, cool, fan only, etc.). When the configuration of the replaced motor and the operations of system controller 108 are unknown, thermostat signals and the motor control signals from system controller 108 enable determination of the operating mode of HVAC system 100. Interface module 102 continuously or periodically monitors an aggregate signal of the system controller signals and the thermostat signals, and compares the resulting aggregate signal with stored reference information to determine the operating mode of the system.

In some embodiments, to acquire the information necessary for determining the system operating mode, interface module 102 is configured to "learn" the HVAC system's operation by implementing a learning algorithm that, over time, enables interface module 102 to recognize and store as a reference the system and thermostat signal combinations and timing that are used to resolve the operating mode of HVAC system 100. In some embodiments, interface module 102 is configured to discriminate between discrete and variable speed motor control as well as recognize a single stage thermostat that is paired with a dual stage system.

In some embodiments, interface module 102 is configured to operate in a "learning mode," for example, in response to instructions received from wireless device 124. While operating in the learning mode, HVAC system 100 is operated in one or more different operating modes (e.g., heat, cool, fan only) within predetermined time periods. In some such embodiments, a user performing an installation and/or update is prompted, for example, by the mobile app, to command HVAC system 100 to operate in these different modes (e.g., using thermostat 106). While operating in each mode, interface module 102 is configured to identify and/or record the system and thermostat signal combinations that are received, enabling interface module 102 to subsequently identify the operating mode based on the system and thermostat signal combinations.

In another embodiment, the information necessary for determining the system operating mode is acquired by teaching interface module 102 to recognize system and thermostat signal combinations. While exercising HVAC system 100 throughout its different modes of operation, the installer manually triggers interface module 102 to capture a "snapshot" of the available inputs for each mode of operation. Interface module 102 correlates each mode of operation with a respective snapshot to identify the system operating modes. A snapshot is a unique combination of states of individual system and thermostat signals, i.e., inputs.

In yet another embodiment, interface module 102 acquires the information necessary for determining the system operating mode via manual configuration of interface module 102 with the appropriate information by a technician or installer of motor 104.

Interface module 102 is configured to implement "ON" delays and "OFF" delays in HVAC systems that allocate this functionality to motor 104. More specifically, interface module 102 facilitates enabling/disabling and/or selecting time values for ON delays and OFF delays for the appropriate system operating modes in order to complete/replicate the HVAC system performance.

Interface module 102 is configured to provide feedback to be utilized by HVAC system 100 to satisfy expectations of system controller 108. Specifically, interface module 102 facilitates enabling/disabling and/or selecting one of a plurality of available motor output signal types. This feature is realized by pairing interface module 102 with a known retrofit/replacement motor that provides a fundamental motor output signal that interface module 102 modifies based on its configuration and passes on to system controller 108.

Interface module 102 is further configured to control motor 104. In operating motor 104, interface module 102 provides a control signal to motor 104 based on signals received from thermostat 106 and system controller 108. In the example embodiment, motor 104 is a "communicating" ECM motor and interface module 102 controls motor 104 using commands. For example, the physical layer of interface module 102 may include serial, controller area network (CAN), wireless, bus, and/or any other standard communications interface/protocol. Interface module 102 provides a single control signal that includes an industry recognized, standard PWM signal to drive motor 104. A duty cycle of the control signal corresponds to a percent of full torque that may be generated by motor 104. Under some circumstances, interface module 102 may pass through to motor 104 a PWM signal received from, for example, system controller 108.

In an alternative embodiment, where motor 104 may need unique programming, such as field programming, for each system, interface module 102 is configured to provide a 0 to 10 Vdc control signal to motor 104.

Interface module 102 in combination with motor 104 is configured to affect airflow that assures safe operation of HVAC system 100. Interface module 102 maintains (e.g., in non-volatile memory) a duty cycle value for each operating mode of HVAC system 100. Initially, default values are used to operate motor 104. During installation, a service technician verifies the airflow in all operating modes to ensure that certain parameters, such as change in temperature and airflow, meet OEM specifications. Interface module 102 provides a user interface 118 for making adjustments to the stored duty cycle values as determined by the technician.

In some embodiments, certain configuration features for interface module are accessible via the mobile app using wireless device 124. Such features may include, for example, HVAC system characterization, horsepower derating, setting ON delays and/or OFF delays, setting second stage delays, setting output channel feedback, setting dehumidification profiles, slew rate adjustment, wireless motor firmware updates or patches, airflow regulation, and/or delta-T (i.e., air temperature difference between an inlet and an outlet of a heat exchanger) regulation. In some embodiments, the mobile app may provide additional information such as, for example, step-by-step instructions for installation and set-up of interface module 102 and/or motor 104.

In some embodiment, interface module 102 is configured to control motor 104 to induce a constant airflow based at least in part on an HVAC system characterization performed by interface module 102. For example, upon installation, or periodically during operation, interface module 102 may control motor 104 to operate at multiple different (e.g., speed and/or torque) setpoints, and receive one or more static pressure measurements while operating at each setpoint. In some such embodiments, interface module 102 is configured to communicate with one or more pressure sensors (e.g., though a direct wired and/or wireless connection, and/or through wireless device 124), from which interface module 102 may receive the one or more static pressure measurements. Alternatively, the static pressure measurements may be taken manually, and entered by a user via user interface 118 and/or wireless device 124. Based on the setpoints and the one or more static pressure measurements, interface module 102 may determine appropriate operating parameters for controlling motor 104 to provide a desired airflow.

Similarly, in some embodiments, interface module 102 is configured to control motor 104 based on a target delta-T. For example, upon installation, or periodically during operation, interface module 102 may control motor 104 to operate at multiple different (e.g., speed and/or torque) setpoints, and receive one or more temperature measurements (e.g., at an inlet and an outlet of a heat exchanger of the HVAC system) while operating at each setpoint. In some such embodiments, interface module 102 is configured to communicate with one or more temperature sensors (e.g., though a direct wired and/or wireless connection, and/or through wireless device 124), from which interface module 102 may receive the one or more static temperature measurements. Alternatively, the temperature measurements may be taken manually, and entered by a user via user interface 118 and/or wireless device 124. Based on the setpoints and the one or more temperature measurements, interface module 102 may determine appropriate operating parameters for controlling motor 104 to provide a desired airflow. For example, a high delta-T value may indicate airflow through the heat exchanger (e.g., across heating and/or cooling coils) is low and should be increased, while a low delta-T value may indicate airflow though the heat exchanger is high and should be decreased.

In some embodiments, interface module 102 is configured to control motor 104 to operate at a derated horsepower. In such embodiments, a user, for example, using user interface 118 and/or wireless device 124 may select a derated horsepower (e.g., a power less than and/or a percentage of the rated horsepower of motor 104) at which to operate motor 104. Interface module 102 is configured to adjust the control signals (e.g., PWM signals and/or duty cycle values) transmitted to motor 104 based on the selection to operate motor 104 at the derated horsepower. Such power derating enables a contractor and/or other entity responsible for installation of motor 104 to stock a single motor type while still having the ability to select a motor having an appropriate power for a given setting.

In some embodiments, when operating in certain operating modes (e.g., cool and/or heat), interface module 102 is configured to control motor 104 to operate in multiple stages, during which motor 104 operates at different setpoints (e.g., speed, torque, or airflow setpoints). For example, when a cooling command is received from thermostat 106, motor 104 may be operated at a first setpoint during a first stage. If the cooling command is still received from thermostat 106 after a preset time period, indicating a temperature setting has not yet been reached, motor 104 may be operated at a second setpoint (e.g., a higher speed and/or airflow) during a second stage. Motor 104 may operate at additional stages (e.g., third, fourth, and so on) according to further preset time periods. These time periods may be set by a user using user interface 118 and/or wireless device 124.

In some embodiments, interface module 102 is configured to operate motor 104 according to one or more predefined groups of settings, sometimes referred to herein as "dehumidification profiles," specifying airflows, stage delays, slew rates, and other settings. These dehumidification profiles may be tailored to certain climates or other environmental conditions under which HVAC system 100 operates. In some embodiments, examples of dehumidification profiles include "humid," "subhumid," "semi-arid," and/or "arid." In a humid climate, motor 104 may be operated to produce a relatively low airflow so that evaporator coils are maintained at an appropriate temperature to avoid blowing humid air into the home or other space treated by HVAC system 100. On the other hand, in an arid climate, the motor 104 for a period of time after the compressor has turned off in order to extract additional cold air.

In some embodiments, interface module 102 is configured to provide output channel feedback based on feedback received from motor 104. As described above, interface module 102 provides this output channel feedback to system controller 108 to satisfy feedback expectations of system controller 108. Additionally, interface module 102 may provide feedback to wireless device 124, which may be configured present the feedback in a user-readable format.

In some embodiments, interface module 102 is configured to control a slew rate, or a rate at which a speed of motor 104 is adjusted from one setpoint to another. In such embodiments, when an airflow demand changes, rather than instantaneously adjusting the speed of motor 104, the speed of motor 104 is gradually adjusted from the initial speed to the target speed, which may reduce undesirable effects on the system such as noise and increased wear and tear. The slew rate may be controlled based on setting input via user interface 118 and/or wireless device 124.

In some embodiments, interface module 102 is configured to provide firmware updates and/or patches to motor 104. Such firmware update and/or patches may be received by interface module 102 from an external source such as wireless device 124. For example, a user may use the mobile app to download a firmware update, for example, via the Internet or another network connection. In response, wireless device 124 and interface module 102 may communicate the update (e.g., serially) to motor 104.

Figure 2:
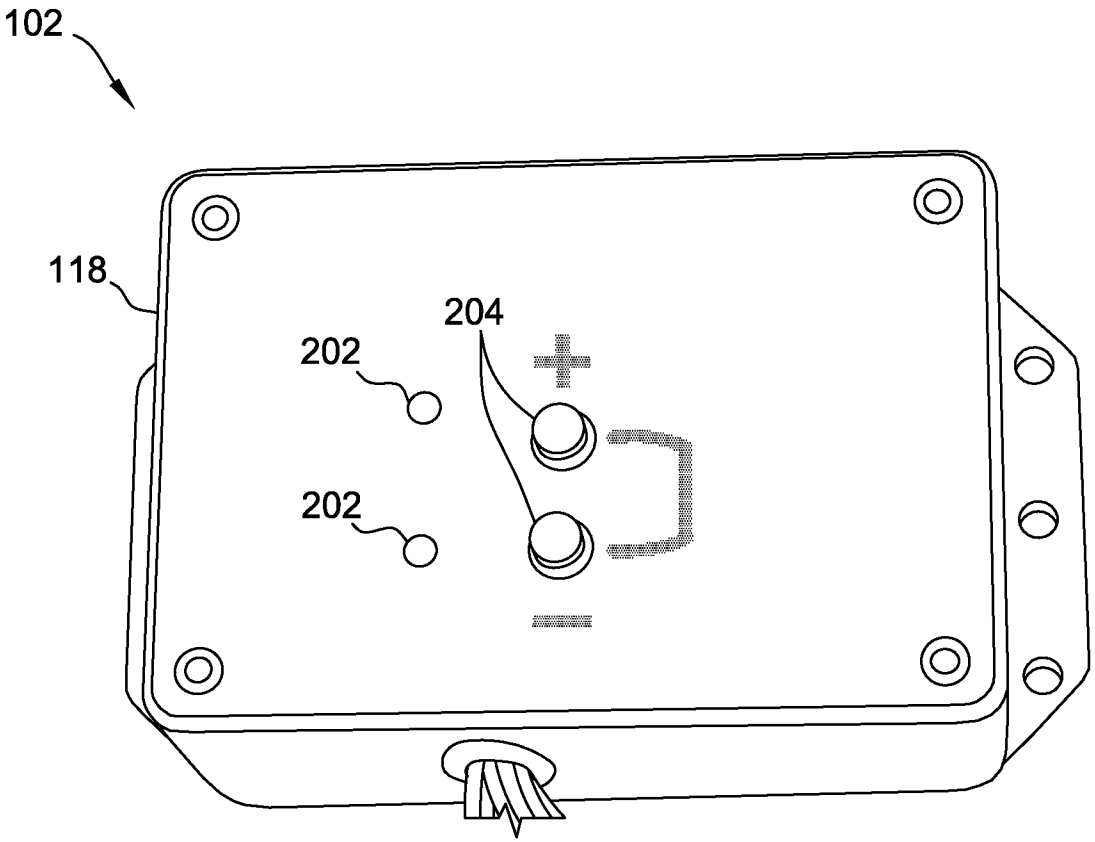
FIG. 2 is a perspective view of an example interface module for use in the HVAC system shown in FIG. 1.

FIG. 2 is a perspective view of interface module 102 including user interface 118. As shown in FIG. 2, in some embodiments, user interface 118 includes one or more indicators 202 (e.g., LEDs) and/or one or more push buttons 204. In such embodiments, at least some of the functions of user interface 118 described above are accessed using indicators 202 and/or push buttons 204, while additional functions may be accessed using wireless device 124 described above with respect to FIG. 1. Alternatively, in some embodiments, interface module 102 includes no onboard user interface 118, and user interface functions are accessed using wireless device 124.

Figure 3:
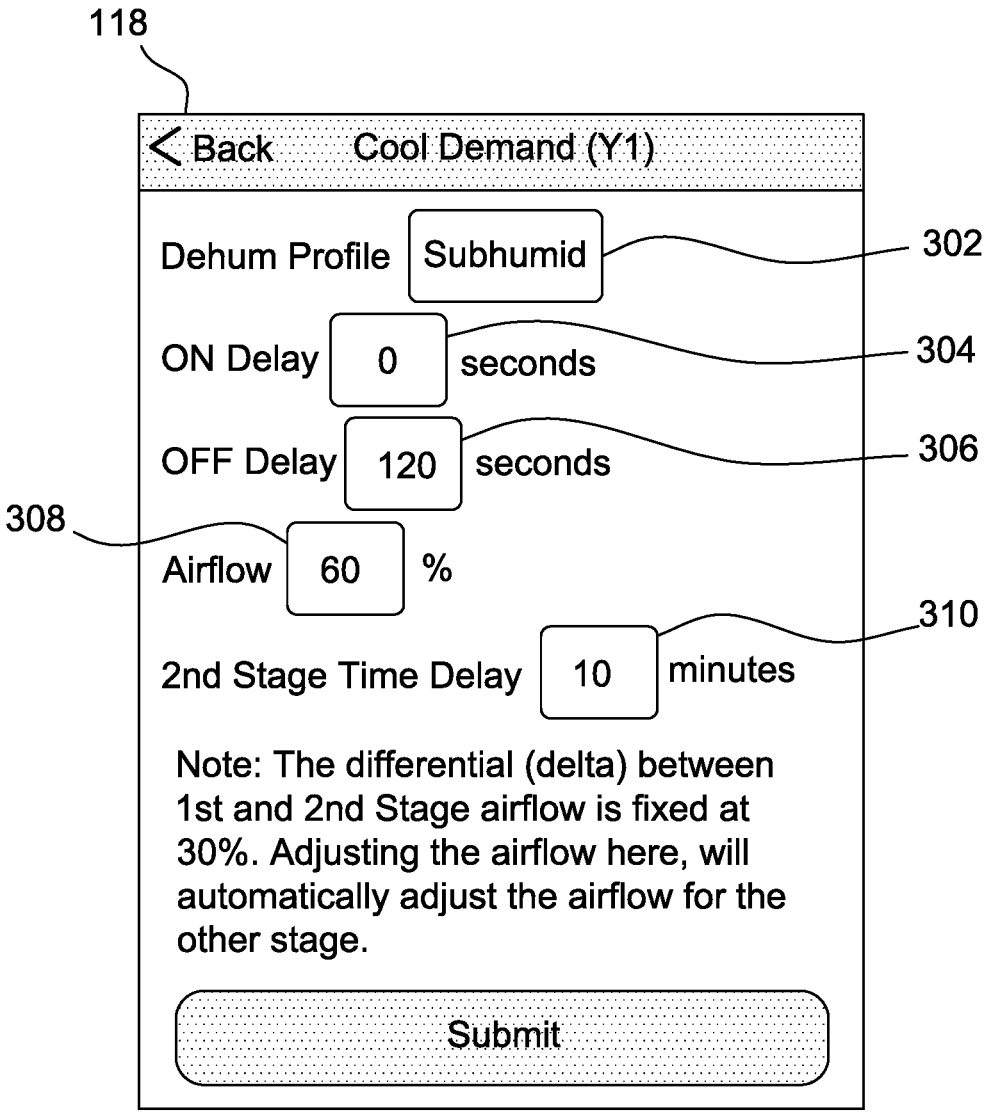
FIG. 3 is an example user interface for use in the HVAC system shown in FIG. 1.

FIG. 3 depicts an example embodiment of user interface 118 implemented as a mobile app displayed by wireless device 124 (shown in FIG. 1). In the example embodiment, user interface 118 includes one or more input fields such as, for example, a dehumidification profile field 302, an ON delay field 304, an OFF delay field 306, an airflow field 308, and/or a second stage delay field. In some embodiments, user interface 118 includes additional fields, which in some such embodiments, may be displayed on different pages within the mobile app to which the user may navigate. For example, different pages within the mobile app may correspond to settings for different operating modes (e.g., cooling, heating, and/or fan only).

Dehumidification profile field 302 provides one or more dehumidification profiles (e.g., "humid," "subhumid," "semi-arid," and/or "arid") from which the user may select. ON delay field 304 and OFF delay field 306 enable the user to select and/or enter specific ON and OFF delay values, respectively. Airflow field 308 enables the user to select and/or enter a desired airflow, and second stage delay field 310 enables the user to enable the user to select and/or enter a delay before a second stage initiates, as described above with respect to FIG. 1.

Figure 4:
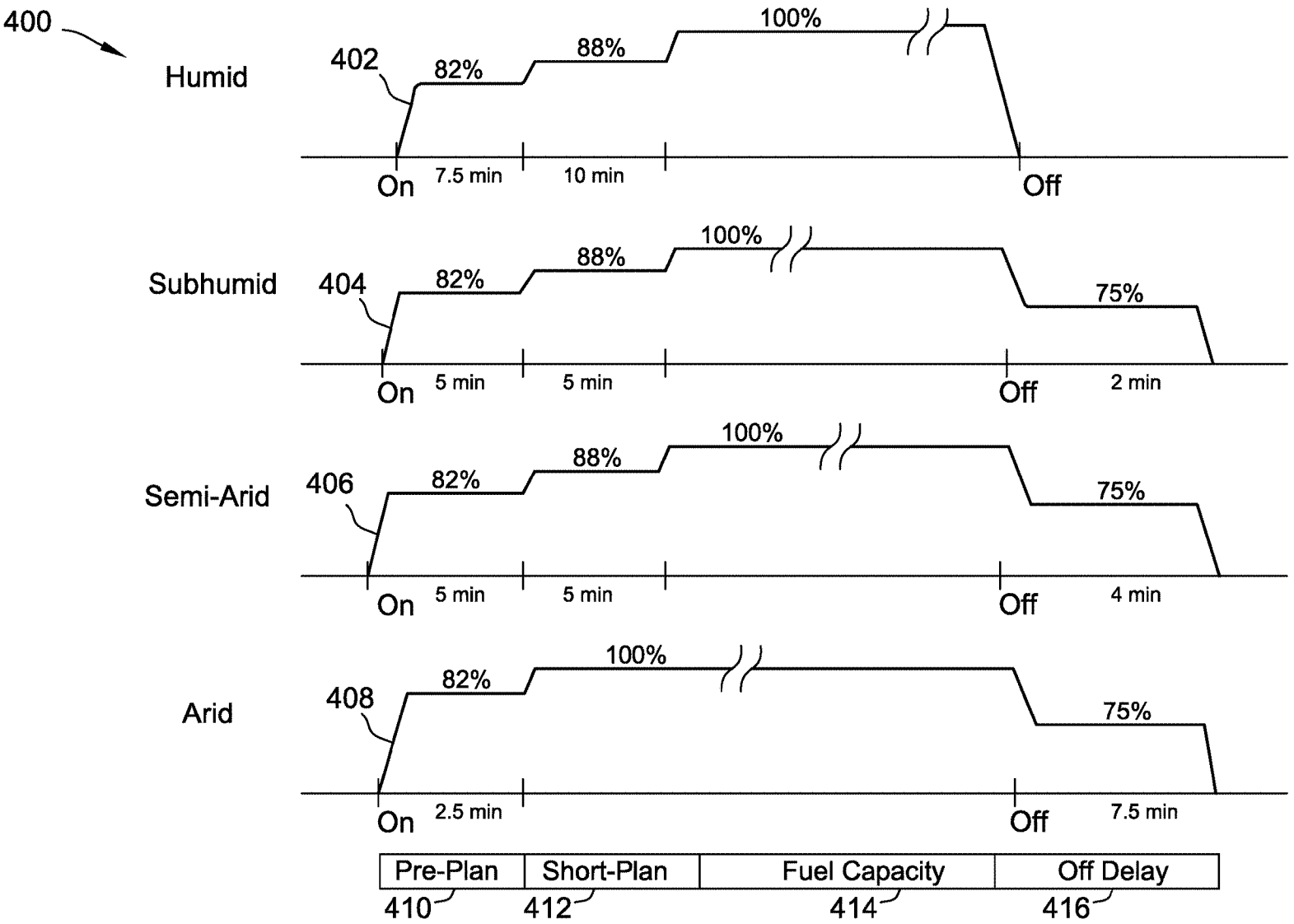
FIG. 4 a chart illustrating four example dehumidification profiles.

FIG. 4 is a chart 400 illustrating four example dehumidification profiles as a function of airflow over time elapsed. The example dehumidification profiles include a humid profile 402, a subhumid profile 404, a semi-arid profile 406, and an arid profile 408. After receiving, for example, a cooling command, interface module 102 operates motor 104 at a specific airflow for each of one or more stages, for example, pre-run stage 410, short run stage 412, full capacity stage 414, and off delay stage 416 (i.e., a stage occurring after the compressor is deactivated). As illustrated by chart 400, the specific airflow command for each stage depends on the dehumidification profile setting.

Figure 5:
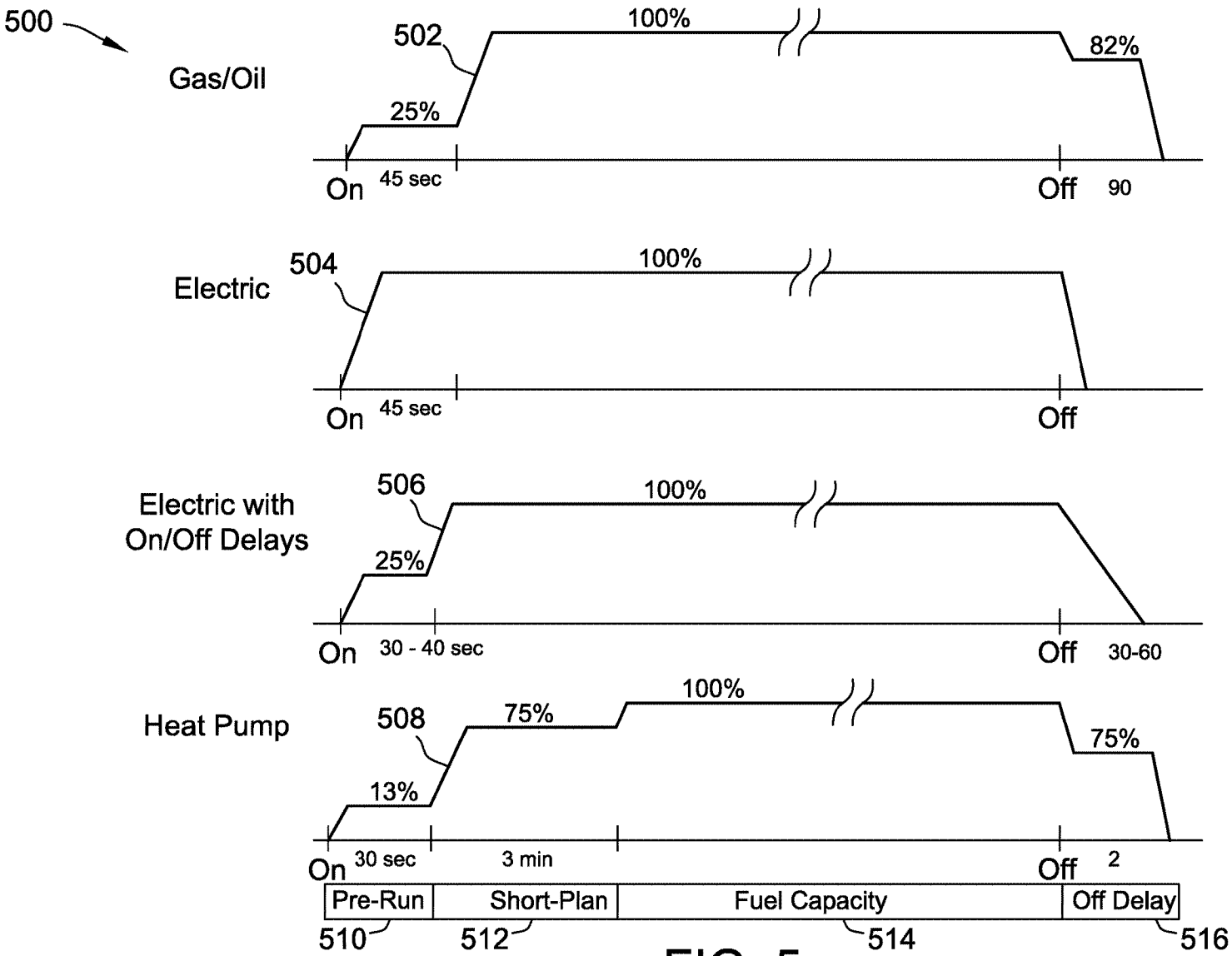
FIG. 5 is chart 500 illustrating four example control profiles.

FIG. 5 is a chart 500 illustrating four example control profiles corresponding to different heating and/or cooling types, shown as a function of airflow over time elapsed. The example control profiles include a gas/oil profile 502, an electric profile 504, an electric with on/off delays profile 506, and a heat pump profile 508. After receiving, for example, a heating or cooling command, interface module 102 operates motor 104 at a specific airflow for each of one or more stages, for example, pre-run stage 510, short run stage 512, full capacity stage 514, and off delay stage 516 (i.e., a stage occurring after the compressor is deactivated). As illustrated by chart 500, the specific airflow command for each stage depends on the specific control profile.

Figure 6:
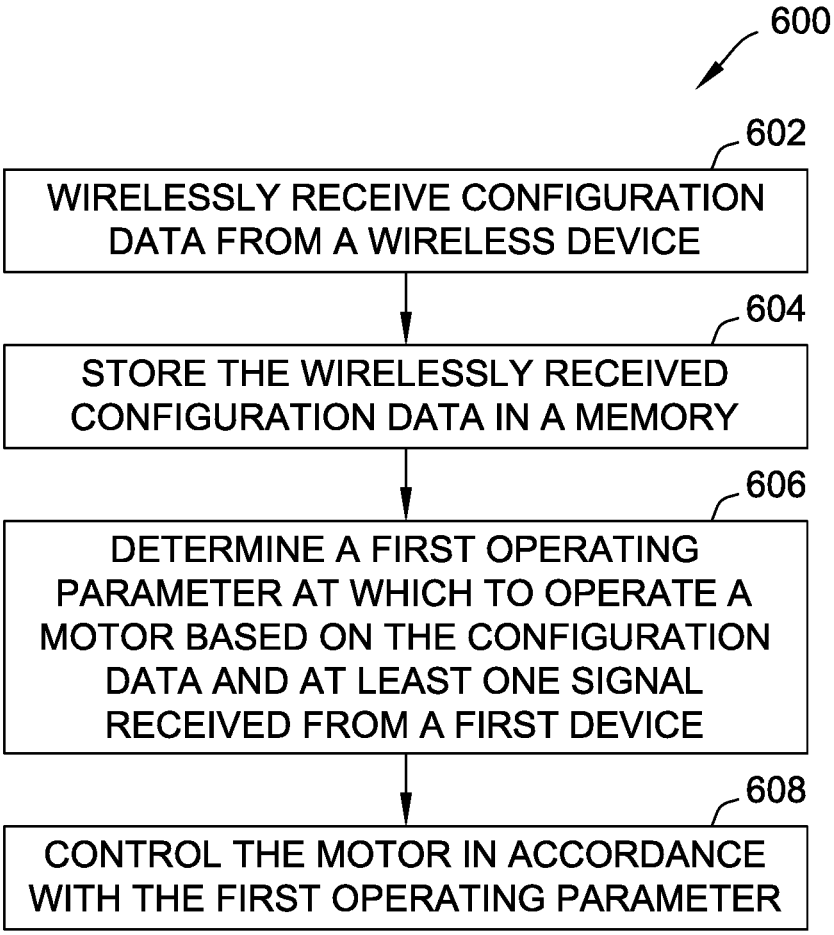
FIG. 6 is a flowchart of an example method of controlling a motor using the interface module shown in FIGS. 1 and 2.

FIG. 6 is a flowchart of an example method 400 of controlling a motor in a HVAC system using interface module 102 (shown in FIG. 1).

Interface module 102 wirelessly receives 602 configuration data from wireless device 124. Interface module 102 stores 604 the wirelessly received configuration data in memory device 116. Interface module 102 determines 606 a first operating parameter at which to operate motor 104 based on the configuration data and at least one signal received from a first device such as, for example, thermostat 106 and/or system controller 108. Interface module 102 controls 608 motor 104 in accordance with the first operating parameter.

In some embodiments, interface module 102 further determines an operating mode based on the at least one signal received from the first device. In some such embodiments, the configuration data defines an operating parameter associated with the operating mode, and to determine the first operating parameter, interface module 102 determines the operating parameter associated with the determined operating mode. In some such embodiments, interface module 102 captures input data associated with available inputs for each operating mode while HVAC system 100 is exercised through each operating mode and correlates each operating mode with respective input data. In some such embodiments, the operating mode is one of a cooling mode, a heating mode, or a fan only mode.

In some embodiments, the configuration data defines a power derating value (e.g., a percentage of the rated power of motor 104), and interface module 102 controls motor 104 to operate at a derated power in accordance with the power derating value.

In some embodiments, the configuration data defines a time delay (e.g., an ON delay or OFF delay), and interface module 102 the time delay before controlling motor 104 in accordance with the first operating parameter.

In some embodiments, the configuration data defines a second stage delay, and interface module 102 controls motor 104 to operate at according to a second operating parameter after a time period of controlling motor 104 to operate according to the first operating parameter based on the second stage delay.

In some embodiments, interface module 102 provides feedback to be utilized by HVAC system 100 to satisfy feedback expectations of the first device (e.g., thermostat 106 and/or system controller 108).

In some embodiments, the configuration data defines a slew rate, and interface module 102 controls motor 104 in accordance with the slew rate.

In some embodiments, interface module 102 is configured for wired serial communication with motor 104. For example, interface module 102 may transmit rotation changes, firmware updates, serial commands, or other motor-specific configuration to motor 104 wirelessly.

In some embodiments, interface module 102 is configured to cause wireless device 122 to display instructions for installation of the motor.

In some embodiments, interface module 102 is coupled in communication with one or more sensors, and interface module 102 controls motor 104 based on measurements received from the one or more sensors Example embodiments of the interface module and methods of controlling a motor are described above in detail. The interface module and methods are not limited to the specific embodiments described herein, but rather, components of the interface module and/or steps of the method may be utilized independently and separately from other components and/or steps described herein. For example, the control system and methods may also be used in combination with other motor systems and methods, and are not limited to practice with only the HVAC system as described herein. Rather, the example embodiments can be implemented and utilized in connection with many other system applications or other support.

A technical effect of the system described herein includes at least one of: (a) determining an operating parameter for a motor using an interface module based on a signal received from a thermostat and/or system controller and on configuration data stored by the interface module; (b) determining an operating mode for a motor in an HVAC system using an interface module based on a signal received from a thermostat and/or system controller and on configuration data stored by the interface module; (c) enabling a readily available, stock, retrofit/replacement motor to communicate with an existing thermostat and/or system controller of an HVAC system using an interface module; (d) wirelessly updating configuration data used by a interface module to determine an operating parameter for a motor using a wireless device configured for wireless communication with the interface module; and (e) reducing a cost of an interface module by providing a user interface through a wireless device configured for wireless communication with the interface module.

In the foregoing specification and the claims that follow, a number of terms are referenced that have the following meanings.

As used herein, an element or step recited in the singular and preceded with the word "a" or "an" should be understood as not excluding plural elements or steps, unless such exclusion is explicitly recited. Furthermore, references to "example implementation" or "one implementation" of the present disclosure are not intended to be interpreted as excluding the existence of additional implementations that also incorporate the recited features.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here, and throughout the specification and claims, range limitations may be combined or interchanged. Such ranges are identified and include all the sub-ranges contained therein unless context or language indicates otherwise.

Disjunctive language such as the phrase "at least one of X, Y, or Z," unless specifically stated otherwise, is generally understood within the context as used to state that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. Additionally, conjunctive language such as the phrase "at least one of X, Y, and Z," unless specifically stated otherwise, should also be understood to mean X, Y, Z, or any combination thereof, including "X, Y, and/or Z."

Some embodiments involve the use of one or more electronic processing or computing devices. As used herein, the terms "processor" and "computer" and related terms, e.g., "processing device," "computing device," and "controller" are not limited to just those integrated circuits referred to in the art as a computer, but broadly refers to a processor, a processing device, a controller, a general purpose central processing unit (CPU), a graphics processing unit (GPU), a microcontroller, a microcomputer, a programmable logic controller (PLC), a reduced instruction set computer (RISC) processor, a field programmable gate array (FPGA), a digital signal processing (DSP) device, an application specific integrated circuit (ASIC), and other programmable circuits or processing devices capable of executing the functions described herein, and these terms are used interchangeably herein. The above embodiments are examples only, and thus are not intended to limit in any way the definition or meaning of the terms processor, processing device, and related terms.

In the embodiments described herein, memory may include, but is not limited to, a non-transitory computer-readable medium, such as flash memory, a random access memory (RAM), read-only memory (ROM), erasable programmable read-only memory (EPROM), electrically erasable programmable read-only memory (EEPROM), and non-volatile RAM (NVRAM). As used herein, the term "non-transitory computer-readable media" is intended to be representative of any tangible, computer-readable media, including, without limitation, non-transitory computer storage devices, including, without limitation, volatile and non-volatile media, and removable and non-removable media such as a firmware, physical and virtual storage, compact disc-read only memory (CD-ROM), digital versatile disc (DVD), and any other digital source such as a network or the Internet, as well as yet to be developed digital means, with the sole exception being a transitory, propagating signal. Alternatively, a floppy disk, a CD-ROM, a magneto-optical disk (MOD), a DVD, or any other computer-based device implemented in any method or technology for short-term and long-term storage of information, such as, computer-readable instructions, data structures, program modules and sub-modules, or other data may also be used. Therefore, the methods described herein may be encoded as executable instructions, e.g., "software" and "firmware," embodied in a non-transitory computer-readable medium. Further, as used herein, the terms "software" and "firmware" are interchangeable and include any computer program stored in memory for execution by personal computers, workstations, clients, and servers. Such instructions, when executed by a processor, cause the processor to perform at least a portion of the methods described herein.

Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the example embodiment, additional output channels may include, but not be limited to, an operator interface monitor.

The systems and methods described herein are not limited to the specific embodiments described herein, but rather, components of the systems and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any layers or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An interface module configured to control a motor in a heating, ventilation, and air conditioning (HVAC) system, said interface module comprising a processor coupled in communication with a memory, said processor configured to:

wirelessly receive configuration data from a wireless device, wherein the wireless device generates the configuration data onboard the wireless device;

store the wirelessly received configuration data in said memory;

in response to instructions received from the wireless device, operate in a learning mode during which the wireless device instructs a user to control a thermostat of the HVAC system to operate in a plurality of operating modes during respective time periods, wherein the thermostat generates a respective thermostat signal while operating in each of the plurality of operating modes;

during each of the respective time periods while the thermostat is operating in a corresponding operating mode of the plurality of operating modes, record a system and thermostat signal combination including the respective thermostat signal that is received in association with each operating mode of the plurality of operating modes;

determine a first operating parameter at which to operate the motor based on the configuration data, the recorded system and thermostat signal combinations, and at least one signal received from a first device; and control the motor in accordance with the first operating parameter.

2. The interface module of claim 1, wherein said processor is further configured to determine an operating mode based on the at least one signal received from the first device.

3. The interface module of claim 2, wherein the configuration data defines an operating parameter associated with the operating mode, and wherein to determine the first operating parameter, said processor is configured to determine the operating parameter associated with the determined operating mode.

4. The interface module of claim 2, wherein said processor is further configured to:

capture input data associated with available inputs for each operating mode while the HVAC system is exercised through each operating mode; and correlate each operating mode with respective input data.

5. The interface module of claim 2, wherein the operating mode is one of a cooling mode, a heating mode, or a fan only mode.

6. The interface module of claim 1, wherein the configuration data defines a power derating value, and wherein said processor is configured to control the motor to operate at a derated power in accordance with the power derating value.

7. The interface module of claim 1, wherein the configuration data defines a time delay, and wherein said processor is configured to implement the time delay before controlling the motor in accordance with the first operating parameter.

8. The interface module of claim 1, wherein the configuration data defines a second stage delay, and wherein said processor is further configured to control the motor to operate at according to a second operating parameter after a time period of controlling the motor to operate according to the first operating parameter based on the second stage delay.

9. The interface module of claim 1, wherein said processor is further configured to provide feedback to be utilized by the HVAC system to satisfy feedback expectations of the first device.

10. The interface module of claim 1, wherein the configuration data defines a slew rate, and wherein said processor is further configured to control the motor in accordance with the slew rate.

11. The interface module of claim 1, wherein said interface module is configured for wired serial communication with the motor.

12. The interface module of claim 1, wherein said interface module is configured to cause the wireless device to display instructions for installation of the motor.

13. The interface module of claim 1, wherein said interface module is coupled in communication with one or more sensors, and wherein said processor is further configured to control the motor based on measurements received from the one or more sensors.

14. A method for controlling a motor in a heating, ventilation, and air conditioning (HVAC) system using an interface module comprising a processor coupled in communication with a memory, said method comprising:

wirelessly receiving configuration data from a wireless device, wherein the wireless device generates the configuration data onboard the wireless device;

storing the wirelessly received configuration data in the memory;

in response to instructions received from the wireless device, operating in a learning mode during which the wireless device instructs a user to control a thermostat of the HVAC system to operate in a plurality of operating modes during respective time periods, wherein the thermostat generates a respective thermostat signal while operating in each of the plurality of operating modes;

during each of the respective time periods while the thermostat is operating in a corresponding operating mode of the plurality of operating modes, recording a system and thermostat signal combination including the respective thermostat signal that is received in association with each operating mode of the plurality of operating modes;

determining a first operating parameter at which to operate the motor based on the configuration data, the recorded system and thermostat signal combinations, and at least one signal received from a first device; and controlling the motor in accordance with the first operating parameter.

15. The method of claim 14, further comprising determining an operating mode based on the at least one signal received from the first device.

16. The method of claim 15, wherein the configuration data defines an operating parameter associated with the operating mode, and wherein determining the first operating parameter comprises determining the operating parameter associated with the determined operating mode.

17. The method of claim 15, further comprising:

capturing input data associated with available inputs for each operating mode while the HVAC system is exercised through each operating mode; and correlating each operating mode with respective input data.

18. The method of claim 15, wherein the operating mode is one of a cooling mode, a heating mode, or a fan only mode.

19. A heating, ventilation, and air conditioning (HVAC) system comprising:

a motor; and an interface module configured to control said motor, said interface module comprising a processor coupled in communication with a memory, said processor configured to:

wirelessly receive configuration data from a wireless device, wherein the wireless device generates the configuration data onboard the wireless device;

store the wirelessly received configuration data in said memory;

in response to instructions received from the wireless device, operate in a learning mode during which the wireless device instructs a user to control a thermostat of said HVAC system to operate in a plurality of operating modes during respective time periods, wherein the thermostat generates a respective thermostat signal while operating in each of the plurality of operating modes;

during each of the respective time periods while the thermostat is operating in a corresponding operating mode of the plurality of operating modes, record a system and thermostat signal combination including the respective thermostat signal that is received in association with each operating mode of the plurality of operating modes;

determine a first operating parameter at which to operate said motor based on the configuration data, the recorded system and thermostat signal combinations, and at least one signal received from a first device; and control said motor in accordance with the first operating parameter.

* * * * *